US007322296B2

(12) United States Patent
Ellis

(10) Patent No.: US 7,322,296 B2
(45) Date of Patent: Jan. 29, 2008

(54) TRAINING GRENADE

(76) Inventor: John William George Ellis, Silver Spring, Goodleigh, Barnstaple, Devon, EX32 7NQ (GB)

( * ) Notice: Subject to any disclaimer, the term of this patent is extended or adjusted under 35 U.S.C. 154(b) by 0 days.

(21) Appl. No.: 11/449,439

(22) Filed: Jun. 7, 2006

(65) Prior Publication Data

US 2007/0283833 A1 Dec. 13, 2007

(51) Int. Cl.
*F42B 8/12* (2006.01)

(52) U.S. Cl. ..... 102/498; 102/488; 102/529; 102/482

(58) Field of Classification Search ..... 102/482, 102/487, 488, 498, 529; 473/577
See application file for complete search history.

(56) References Cited

U.S. PATENT DOCUMENTS 1,481,635 A 1/1924 Councilman
2,358,647 A 9/1944 Witkor
2,408,486 A * 10/1946 Shinkle ..... 102/488

FOREIGN PATENT DOCUMENTS

| | | |
|---|---|---|
| AT | 342 463 | 4/1978 |
| CH | 145 184 | 2/1931 |
| FR | 592 444 | 8/1925 |
| GB | 102 279 | 11/1916 |

* cited by examiner

*Primary Examiner*—James S Bergin
(74) *Attorney, Agent, or Firm*—Melvin I. Stoltz

(57) ABSTRACT

A training grenade includes a main body, a cartridge chamber removably connected to the main body, a firing pin mechanism for actuating the cartridge and a toggle for operating the firing pin mechanism, the toggle being contained within the main body.

9 Claims, 2 Drawing Sheets

TRAINING GRENADE

FIELD OF THE INVENTION

This invention relates to a training grenade, i.e. a reusable grenade for use in the training of military and police recruits.

Training grenades are well known and typically include a pyrotechnic device operated by a lever with a time delay mechanism ensuring that there is a delay between the release of the lever and the explosion of the pyrotechnic device. For training purposes, the pyrotechnic device usually consists of a small amount of the mixture used in operational grenades. Once used, the empty body of the grenade is discarded and such grenades are, therefore, expensive to use.

A blank-firing training grenade is described in British Patent Specification No. 2 280 249. This includes a removable cartridge chamber that can be used with adaptors to take blank cartridges of different sizes.

It is an object of the present invention to provide an improved form of training grenade.

SUMMARY OF THE INVENTION

According to the present invention there is provided a training grenade that includes a main body, a cartridge chamber removably connected to the main body, a firing pin mechanism for actuating the cartridge and a toggle for operating the firing pin mechanism, the toggle being contained within the main body.

The firing pin mechanism is preferably acted on by a spring to bias it away from the cartridge chamber.

The toggle is preferably of significant mass and includes a portion that projects from the main body and the arrangement is preferably such that, when the grenade is thrown and falls on a hard surface, the grenade will be operated by impact with the hard surface in whatever position it falls.

The toggle is preferably arranged so that, if the projecting portion of the toggle strikes the hard surface, the toggle will be driven onto the firing pin and will thus fire the cartridge. If the end of the grenade opposite the toggle falls onto the hard surface, the inertia in the toggle will result in movement of the toggle and activation of the firing pin. If the grenade falls onto its side, the bending over of the toggle will produce activation of the firing pin.

A lever may be provided that includes a portion so formed as to shroud the toggle for safety and training use, the lever being held in engagement with the toggle by means of a ring-pin that is removable prior to throwing the grenade. An ejection spring preferably acts between the lever and the toggle so as to urge the lever away from the toggle when the lever is released by pulling on the ring pin.

A clip may alternatively be provided for holding the toggle against movement relative to the main body of the grenade.

DESCRIPTION OF THE PREFERRED EMBODIMENTS

Figure 1:
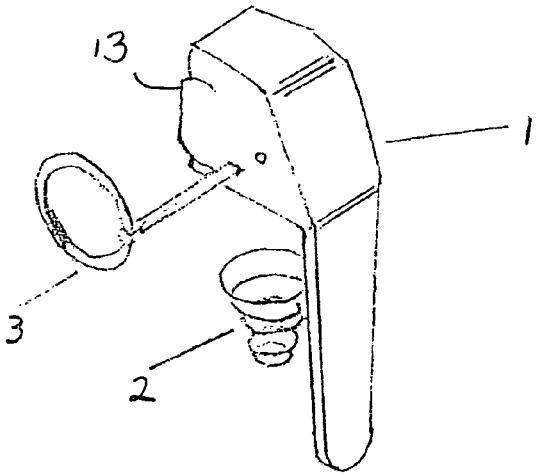
FIG. 1 is a perspective view of a lever, an ejection spring and a ring-pin for a training grenade.

As shown in the drawings, the training grenade includes a generally cylindrical main body 4 of iron or steel, suitably powder-coated to prevent corrosion thereof, and a removable cartridge chamber 5 that has threaded engagement in one end of the main body 4. The removable cartridge chamber 5 is fitted with a blank cartridge (not shown) and, if the blank cartridge that is being used is relatively small, an adaptor (not shown) can be fitted in the cartridge chamber 5, as described in British Patent Specification No. 2 280 249.

A metal toggle 7 is contained within the main body 4 and is held within a bore of the main body 4 by means of a cap 12 that has threaded engagement in the other end of the main body 4. The toggle 7 has a ball and socket connection with a firing pin 8 that is acted on by a spring 9, so that the firing pin 8 is normally in the safe position shown in FIG. 6.

Figure 6:
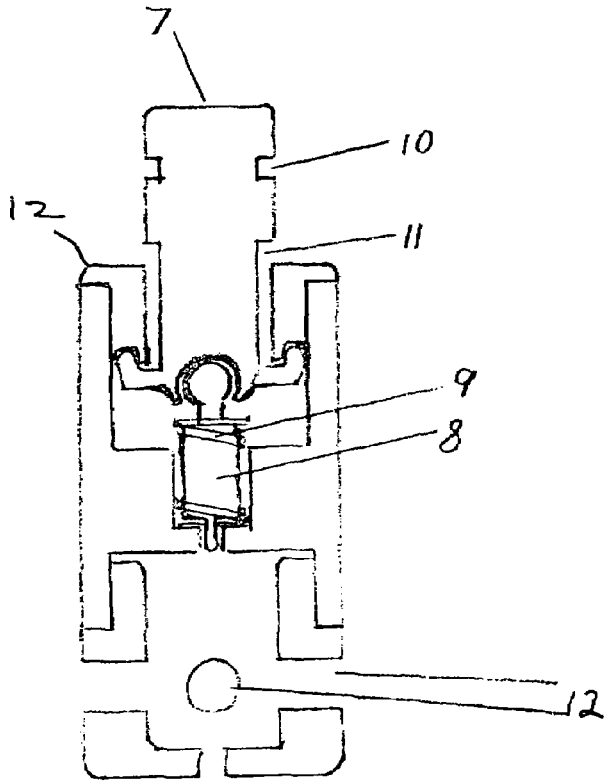
FIG. 6 is a sectional view of the training grenade showing the firing pin in its "at rest" or non-activated position.

There is a space 11 between the top of the cap 12 and the adjacent part of the toggle 7 and a clip 6 (see FIG. 3) can be fitted in this space 11 to prevent movement of the toggle 7 relative to the main body 4 of the training grenade, i.e. to hold the toggle 7 in the safe position shown in FIG. 6.

Figure 2:
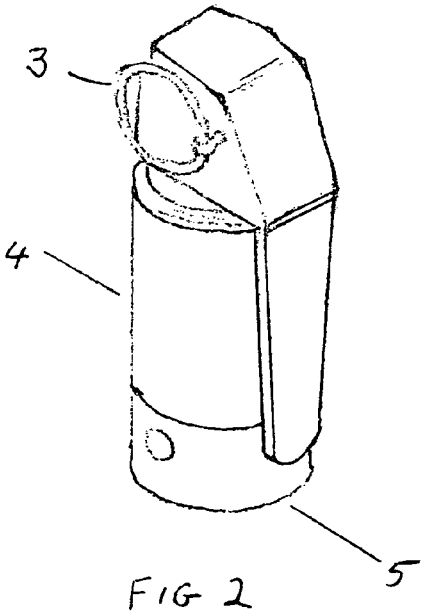
FIG. 2 is a perspective view of a complete training grenade fitted with the lever, ejection spring and ring-pin of FIG. 1.

As an alternative to using the clip 6, the toggle 7 can be prevented from movement out of its safe position by means of a lever 1 that is held releasably in engagement with the toggle 7 by means of a ring pin 3 that is received in a groove 10 in the toggle 7. The end of the toggle 7 is received in a recess in the lever 1 so as to be shrouded by the lever 1. A spring 2 acts between the base of the recess in the lever 1 and the end of the toggle 7. A shoulder 13 is formed on the lever 1 and the arrangement is such that, in the storage position shown in FIG. 2, the ring of the ring-pin 3 fits over the shoulder 13 and is thus held against inadvertent movement relative to the lever 1.

When throwing a grenade fitted with a lever 1, the ring-pin 3 is withdrawn and then, when the grenade leaves the thrower's hand, the lever 1 is thrown clear of the toggle 7 by means of the spring 2 leaving the toggle 7 free to move when the grenade hits the ground. If the grenade lands in such a manner that the end of the toggle 7 hits the ground, the toggle 7 will press against the firing pin 8 to cause it to move against the action of the spring 9, thus causing the pin 8 to be driven into the primer of the cartridge in the chamber 5. The cartridge will then explode and the explosion exits through the explosion holes 12 in the wall of the cartridge chamber 5.

If the grenade lands in such a manner that the other end of the grenade hits the ground, the toggle 7 will continue to move relative to the main body 4 of the grenade as a result of its inertia and will again cause displacement of the firing pin 8 so that it is driven into the primer of the cartridge, producing an explosion.

Figure 5:
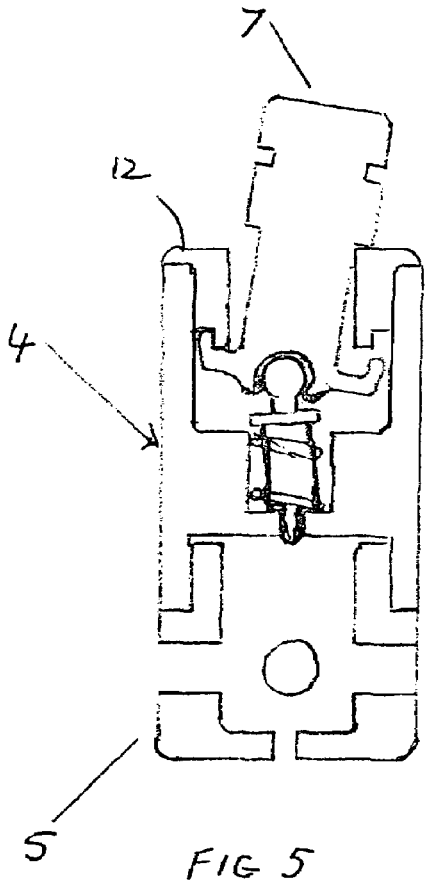
FIG. 5 is a sectional view of the training grenade showing the firing pin in its activated position.

If the grenade lands on its side, the inertia of the toggle 7 will cause pivotal movement of the toggle 7, as illustrated in FIG. 5, and will again produce displacement of the firing pin 8 to drive it into the primer of the cartridge. After the explosion has taken place, the toggle 7 is returned to its upright position, as shown in FIG. 6, by the spring 9.

The grenade will thus be operated by impact with the floor in whatever position it falls and, after use, the expired cartridge can be removed and replaced by a new cartridge ready for the next operation. The method in which the training grenade is thrown and the weight thereof corresponds to the method of use and the weight of an actual hand grenade.

Figure 3:
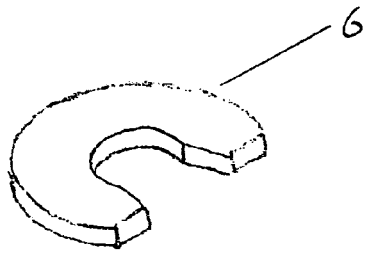
FIG. 3 is a perspective view of a clip for a training grenade.
Figure 4:
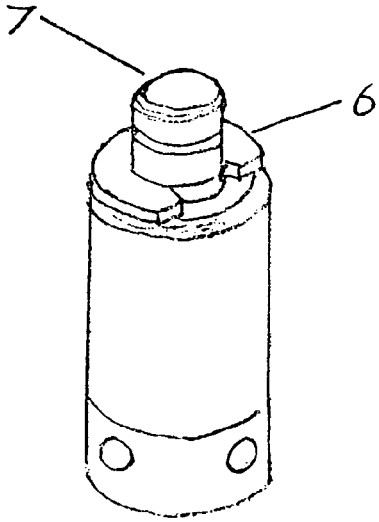
FIG. 4 is a perspective view of a complete training grenade fitted with the clip of FIG. 3.

If a clip 6 is provided, as shown in FIGS. 3 and 4, the clip 6 is merely detached from the toggle 7 before the training grenade is thrown.

The invention claimed is:

1. A training grenade that includes a main body, a cartridge chamber removably connected to the main body, a firing pin mechanism for actuating the cartridge and a toggle for operating the firing pin mechanism, the toggle having a first end contained within the main body and a second end that projects from the main body, the first end of the toggle being connected to the firing pin mechanism by a ball and socket joint.

2. A training grenade as claimed in claim 1, in which the firing pin mechanism is acted on by a spring to bias it away from the cartridge chamber.

3. A training grenade as claimed in claim 1, which is so designed that, when the grenade is thrown and falls on a hard surface, the grenade will be operated by impact with the hard surface in whatever position it falls.

4. A training grenade as claimed in claim 3, in which the toggle is arranged so that, if the second end of the toggle strikes the hard surface, the toggle will be driven onto the firing pin and will thus fire the cartridge and, if the end of the grenade opposite the toggle falls onto the hard surface, the inertia in the toggle will result in movement of the toggle and activation of the firing pin.

5. A training grenade as claimed in claim 3, which is so designed that, if the grenade falls onto its side, the bending over of the toggle will produce activation of the firing pin.

6. A training grenade as claimed in claim 1, which includes a lever having a portion so formed as to shroud the toggle for safety and training use.

7. A training grenade as claimed in claim 6, in which the lever is held in engagement with the toggle by means of a ring-pin that is removable prior to throwing the grenade.

8. A training grenade as claimed in claim 7, in which an ejection spring acts between the lever and the toggle so as to urge the lever away from the toggle when the lever is released by pulling on the ring pin.

9. A training grenade as claimed in claim 1, in which a clip is provided for holding the toggle against movement relative to the main body of the grenade.

* * * * *